US006578503B2

(12) United States Patent
Matsuzawa et al.

(10) Patent No.: US 6,578,503 B2
(45) Date of Patent: Jun. 17, 2003

(54) EMBROIDERY SEWING MACHINE WITH LOWER THREAD WINDING DEVICE

(75) Inventors: Kiyoshi Matsuzawa, Chofu (JP); Minoru Hayashi, Chofu (JP); Fumio Wada, Chofu (JP); Yuichi Sukegawa, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/160,448

(22) Filed: May 30, 2002

(65) Prior Publication Data

US 2003/0005870 A1 Jan. 9, 2003

(30) Foreign Application Priority Data

May 31, 2001 (JP) ..... 2001-165278

(51) Int. Cl.[7] ..... D05C 5/02; D05B 59/00
(52) U.S. Cl. ..... 112/102.5; 112/279
(58) Field of Search ..... 112/102.5, 470.01, 112/470.06, 279, 278

(56) References Cited

U.S. PATENT DOCUMENTS 5,322,028 A * 6/1994 Hashiride et al. ..... 112/278
6,138,594 A * 10/2000 Kito ..... 112/470.01

FOREIGN PATENT DOCUMENTS

JP 11-342283 12/1999

* cited by examiner

*Primary Examiner*—Peter Nerbun
(74) *Attorney, Agent, or Firm*—Merchant & Gould P.C.

(57) ABSTRACT

In an embroidery sewing machine having a lower thread winding device, when the non-lower thread state of the bobbin is detected by a residual amount sensor, a sewing machine motor is stopped to detect and recognize the size of the embroidering frame of an embroidering device by means of a frame size sensor and the embroidering frame is moved corresponding to the size to position the corner of a workpiece held in the embroidering frame under a needle. Then, an extra sewing operation is carried out over the corner to consume the lower thread remaining in the bobbin, and subsequently, it is decided whether or not the embroidering frame is moved by a distance required for completely extracting the lower thread from the bobbin (an amount of the residual lower thread is detected when the non-thread state is detected by the residual amount sensor). If the distance is insufficient, the destination of the embroidering frame is updated to repeat the extra sewing operation over the next corner of the workpiece S, thereby completely extracting the lower thread from the bobbin.

10 Claims, 7 Drawing Sheets

EMBROIDERY SEWING MACHINE WITH LOWER THREAD WINDING DEVICE

BACKGROUND OF THE INVENTION

1. Field of the Invention

The present invention relates to an embroidery sewing machine having a lower thread winding device, and more particularly to the extracting control of a lower thread remaining in the bobbin of the sewing machine.

2. Description of the Related Art

Conventionally, JP-A-11-342283 has proposed an embroidery sewing machine having a lower thread winding device capable of supplying a lower thread to a bobbin without removing the bobbin from a horizontally rotary hook which comprises a removable embroidering device.

In the embroidery sewing machine having a lower thread winding device, the embroidering device is removably attached to the bed of a sewing machine body and the lower thread winding device is provided under the throat plate of the sewing machine bed. The embroidering device serves to carry out embroidering with a predetermined shape in cooperation with a needle attached to a needle bar while moving an embroidering frame in longitudinal and transverse (XY) directions with a workpiece set to the embroidering frame.

The lower thread winding device is basically constituted by a horizontally rotary hook including, in an outer hook, an inner hook for accommodating a bobbin, a needle bar separating mechanism, a bobbin driving member coupled to the outer hook through a gear, bobbin driving member moving means, a thread hold moving member, and thread holding member moving means.

The lower thread winding device separates the needle bar having a needle attached thereto during the starting operation of the sewing machine to stop the vertical motion of the needle bar and to hold the needle bar above the throat plate by means of a needle bar separating mechanism or an upper shaft crank mechanism during a thread winding operation. On the other hand, the thread holding member moving means is driven by a motor, thereby moving the thread holding member through the thread holding member moving means and causing the tip portion of the thread holding member to abut on the upper flange of the bobbin in the inner hook. The tip portion of the thread holding member holds a lower thread (a thread for the lower thread) led out of a thread piece between a thread position regulating portion and a holding portion engaging a thread end portion, and a thread portion between the thread position regulating portion and the holding portion is pushed against the outer peripheral edge of the upper flange of the bobbin.

Furthermore, the bobbin driving member moving means is operated by the thread holding member moving means, thereby driving the bobbin driving member and coupling the outer hook and the bobbin by the gear through the bobbin driving member. The outer hook is rotated by the rotation of the lower shaft of the sewing machine.

Consequently, when the outer hook is rotated by the driving operation of the sewing machine, the bobbin is rotated (in a reverse direction to the outer hook), and the thread portion of the tip part of the thread holding member pushed against the outer peripheral edge of the upper flange is caught by a slit formed on the upper flange, and the thread portion succeeding thereto is pulled out of the thread piece so that the lower thread is wound upon the central shaft of the bobbin.

In the embroidery sewing machine having a lower thread winding device, however, in the case in which the lower thread wound upon the bobbin is lessened during the sewing operation, the needle is stopped above a workpiece and the embroidering frame is then moved to pull the lower thread out of the back side of a final stitch so that the lower thread remaining in the bobbin is extracted. For this reason, conventionally, there is a drawback that the lower thread cannot be completely extracted from the bobbin if the lower thread remains in a large amount in the bobbin.

SUMMARY OF THE INVENTION

It is an object of the invention to provide an embroidery sewing machine having a lower thread winding device which can completely extract a lower thread remaining in a bobbin when the lower thread in the bobbin is gone.

In order to attain the object, as shown in FIGS. 1 and 2, for example, a first aspect of the invention is directed to an embroidery sewing machine 100 having a lower thread winding device 1 for guiding a thread for a lower thread to a bobbin 22 in a hook and for rotating the bobbin 22 to wind the thread thereupon, comprising an embroidering device 240 for making an embroidery on a workpiece S held in an embroidering frame 239 to be moved in X and Y directions, wherein when the lower thread wound upon the bobbin is lessened, the embroidering frame 239 is moved in a direction of a corner and the lower thread remaining in the bobbin is extra sewn onto a corner of the workpiece S held in the embroidering frame 239 and is thus extracted from the bobbin.

According to the first aspect of the invention, the following functions and effects can be obtained.

(1) Since the lower thread remaining in the bobbin is extra sewn onto the corner of the workpiece, the lower thread can be pulled out in a large amount from the bobbin and can be extra sewn and the lower thread can be completely extracted without a remainder in the bobbin so that the reliability of a lower thread extracting process can be enhanced.

(2) Since the lower thread remaining in the bobbin is extra sewn onto the corner of the workpiece, the extra sewing can be carried out excluding an embroidery to be made on the workpiece. Consequently, the embroidery can be prevented from being damaged by the extracting process based on the lower thread extra sewing operation.

A second aspect of the invention is directed to the sewing machine according to the first aspect of the invention, wherein when the lower thread wound upon the bobbin is lessened, the embroidering frame is moved in the direction of the corner to locate a needle, and is further moved in a direction of another corner.

A third aspect of the invention is directed to the sewing machine according to the first or second aspect of the invention, wherein a size of the embroidering frame is recognized and the embroidering frame is moved in the direction of the corner of the workpiece corresponding to the size of the embroidering frame to locate the needle, thereby carrying out extra sewing.

According to the third aspect of the invention, the embroidering frame is moved corresponding to the size thereof, thereby extra sewing the corner of the workpiece. Therefore, it is possible to execute the extracting process by the extra sewing operation of the lower thread in an amount of movement which corresponds to the size of the embroidering frame and has no waste.

A fourth aspect of the invention is directed to the sewing machine according to the first, second or third aspect of the invention, wherein the extra sewing is performed in a position excluding a position in which embroidering is being carried out or is to be carried out.

According to the fourth aspect of the invention, even if the embroidery reaches the corner of the workpiece, the extra sewing is carried out in the position excluding the embroidery. Therefore, the embroidery can be prevented from being damaged by the extracting process based on the lower thread extra sewing.

A fifth aspect of the invention is directed to the sewing machine according to the first, second, third or fourth aspect of the invention, wherein after the extra sewing is ended, the lower thread is automatically started to be wound.

According to the fourth aspect of the invention, since the lower thread is automatically started to be wound after the extra sewing operation of the lower thread is ended, it is possible to completely automate a work from the operation for extracting the lower thread remaining in the bobbin to the operation for newly winding the lower thread.

DESCRIPTION OF THE PREFERRED EMBODIMENTS

An embodiment of the invention will be described below in detail with reference to the drawings.

Figure 1:
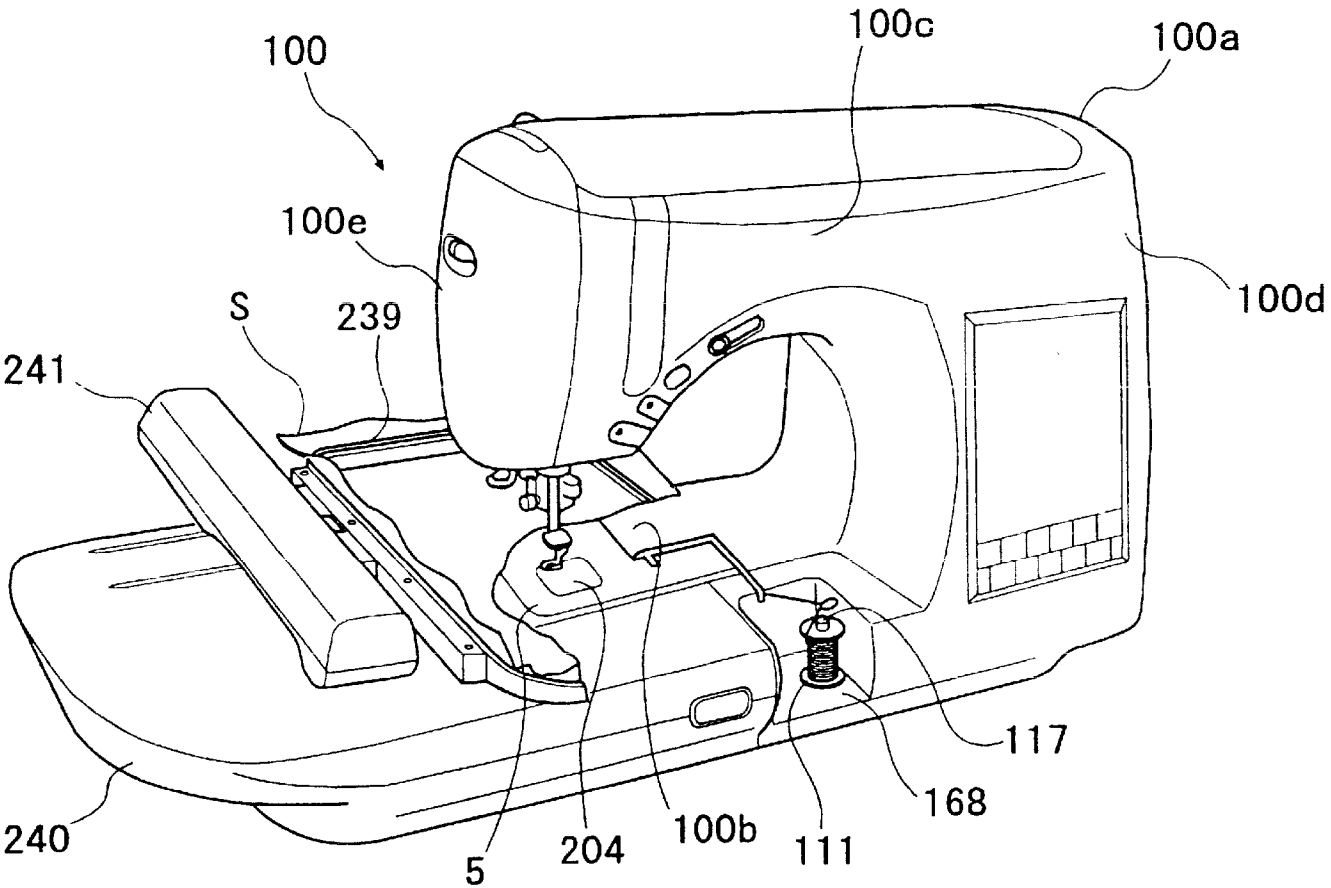
FIG. 1 is a perspective view showing an embroidery sewing machine having a lower thread winding device according to an embodiment of the invention.

In the embodiment according to the invention, an embroidery sewing machine 100 having a lower thread winding device comprises a sewing machine body 100*a* having an almost U-shaped front surface, and the sewing machine body 100*a* connects a sewing machine bed 100*b* provided in a lower part and a sewing machine arm 100*c* provided in an upper part in parallel therewith through a pedestal portion 100*d* as shown in FIG. 1. A well-known embroidering device 240 having an almost U-shaped plane is removably attached to the sewing machine bed 100*b*.

The embroidering device 240 can make an embroidery with a predetermined shape in cooperation with a needle 3 (FIG. 2) while moving an embroidering frame 239 in longitudinal and transverse (XY) directions by an X motor and a Y motor in a carriage 241 with the embroidering frame 239 attached to the carriage 241 and a workpiece S set to the embroidering frame 239.

The sewing machine bed 100*b* is provided with a lower thread piece attachment portion 168 in a position set in the proximity of the sewing machine pedestal portion 100*d*, and the lower thread piece attachment portion 168 is provided with a thread rod 117 for rotatably supporting a lower thread piece 111. The lower end of a sewing machine head 100*e* on a free end positioned on the opposite side of the pedestal portion 100*d* in the sewing machine arm 100*c* is provided with a cloth presser 208 for pressing the workpiece S from above.

Figure 2:
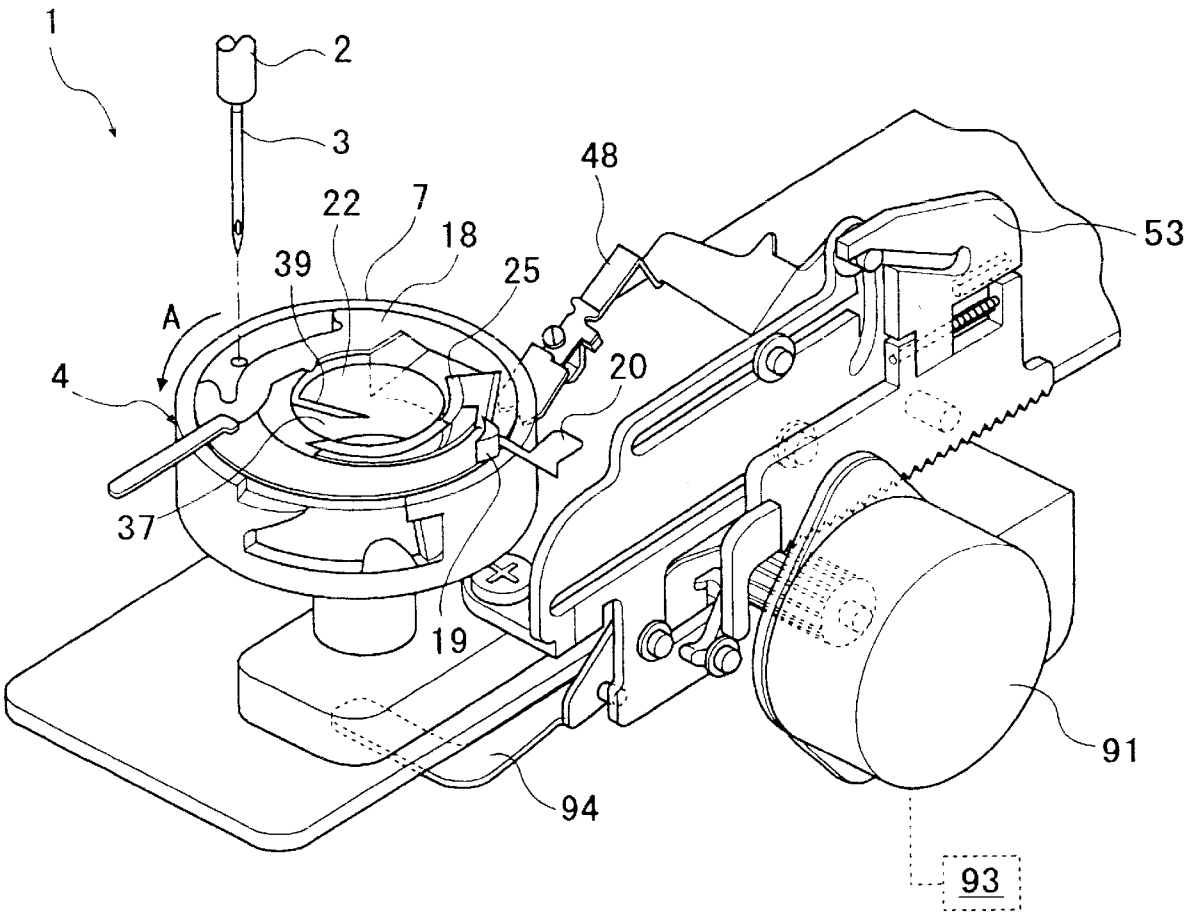
FIG. 2 is a perspective view showing the main part of the lower thread winding device in the sewing machine of FIG. 1.

According to the embodiment, the lower thread winding device is provided in the lower position of a throat plate 5 in the sewing machine bed 100*b*. As shown in FIG. 2, the lower thread winding device is basically constituted by a needle bar separating mechanism or an upper shaft crank mechanism which is not shown, a bobbin driving member which is coupled to an outer hook 7 through a gear and is not shown, bobbin driving member moving means 94, a thread hold moving member 48 and thread holding member moving means 53.

A lower thread winding device 1 separates a needle bar 2 having a needle 3 attached thereto through the rotation of the upper shaft of the sewing machine by means of the needle bar separating mechanism or separates a sewing machine motor from the upper shaft by means of the upper shaft crank mechanism, thereby stopping the vertical motion of the needle bar 2 and holding the needle bar 2 above the throat plate 5 provided over the hook 4 during a thread winding operation. On the other hand, the thread holding member moving means 53 is driven by a motor 91 to rotate the thread holding member 48 by the thread holding member moving means 53, and the tip portion of the thread holding member is lifted along the outer hook 7 and is further moved forward toward an inner hook 4, thereby abutting on an upper flange 37 of a bobbin 22 in the inner hook 4. The tip portion of the thread holding member 48 holds a lower thread led from a thread piece for the lower thread (an upper thread led from a thread piece for the upper thread is utilized as the lower thread in some cases) between a thread position regulating portion and a holding portion engaging a thread end part, and a thread portion between the thread position regulating portion and the holding portion is pushed against the outer peripheral edge of the upper flange 37 of the bobbin 22.

Furthermore, the bobbin driving member moving means 94 is operated by the thread holding member moving means 53 to drive and lift the bobbin driving member penetrating through the small diameter portion of the lower part of the outer hook 7, thereby coupling the gear of the outer hook 7 to a gear in the lower flange of the bobbin 22 through a gear provided on the upper end of the bobbin driving member. The outer hook 7 is rotated by the rotation of a lower shaft interlocked with the rotation of the upper shaft of the sewing machine through a screw gear fixed to the lower part of the small diameter portion (the bobbin driving member penetrates through the screw gear).

When the outer hook 7 is normally rotated in the direction of an arrow A by the driving operation of the sewing machine, the bobbin 22 is rotated (in a reverse direction to the outer hook 7), the thread portion in the tip part of the thread holding member 48 pushed against the outer peripheral edge of the upper flange 37 is caught by a slit 39 of the upper flange 37 and a thread portion succeeding thereto is pulled out of the thread piece through tension applying means 25 and a tensioner which is not shown so that the lower thread is wound upon the central shaft of the bobbin 22.

Figure 3:
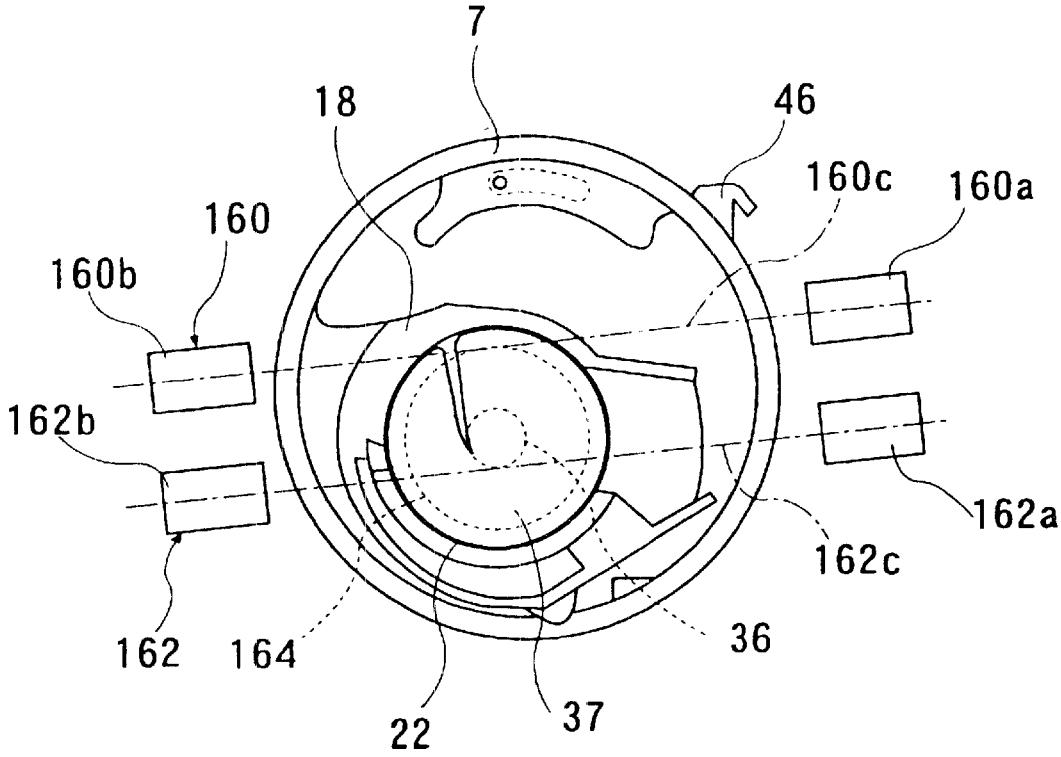
FIG. 3 is a plan view showing a state in which a lower thread limit sensor and a residual amount sensor are installed in the inner bobbin of a horizontally rotary hook in the sewing machine of FIG. 1.

As shown in FIG. 3, the lower thread winding device is provided with maximum thread winding diameter detecting means (a limit sensor) 160 for detecting the maximum thread winding diameter of the lower thread to be wound upon the bobbin 22 and lower thread residual amount detecting means (a residual amount sensor) 162 for detecting an amount of the lower thread remaining in the bobbin 22 when the lower thread in the bobbin 22 is consumed and lessened.

The limit sensor 160 comprises an optical sensor having a light emitting element 160*a* and a light receiving element 160*b* which are opposed to each other in the vicinity of the upper end of the outer hook 7, and is provided such that a light emitted from the light emitting element 160*a* can detect a winding layer surface 164 wound to have a set maximum thread winding diameter upon the central shaft 36 of the bobbin 22 in a position between the upper flange 37 and the lower flange in the bobbin 22.

In the limit sensor 160, an optical path 160*c* is not blocked before the lower thread wound upon the bobbin 22 reaches the maximum thread winding diameter, and the light receiving element 160*b* is continuously maintained to be ON to output a maximum current. When the maximum winding diameter is reached, the optical path 160*c* is blocked so that the light receiving element is turned OFF, an output current is decreased and the minimum current having a detection level is output. Accordingly, if a threshold is provided between a maximum output current and a minimum output current and it is detected that the light receiving element is turned OFF, it is possible to detect that the lower thread wound upon the bobbin 22 reaches the maximum thread winding diameter and to know that a lower thread winding end point is reached. The output signal of the light receiving element 160*b* is sent to a control portion 93 for controlling the low thread winding device 1 and each portion of the sewing machine to carry out a signal processing so that the maximum thread winding diameter can be finally detected by a CPU provided in the control portion 93.

Similarly, the lower thread residual amount sensor 162 comprises an optical sensor including a light emitting element 162*a* and a light receiving element 162*b* which are opposed to each other in the vicinity of the upper end of the outer hook 7, and a basic structure is the same as that of the limit sensor 160 except for an optical path. An optical path 162*c* through which a light emitted from the light emitting element 162*a* of the residual amount sensor 162 reaches the light receiving element 162*b* is positioned close to the surface of the central shaft 36 of the bobbin 22.

In the residual amount sensor 162, the optical path 162*c* is blocked and the light receiving element 162*b* is continuously maintained to be OFF before the lower thread remaining in the bobbin 22 is lessened and the amount of the remainder is decreased to approximately three to four winding times depending on the thickness of the thread, for example. If the amount of the lower thread is further decreased, the optical path 162*c* is not blocked so that the light receiving element 162*b* is turned ON. Accordingly, if a threshold is provided between a minimum output current during OFF and a maximum output current during ON and it is detected that the light receiving element is turned ON, it is possible to detect a non-thread state in which the amount of the lower thread remaining in the bobbin 22 is equal to or smaller than a predetermined value. A signal output from the light receiving element 162*b* of the residual amount sensor 162 is sent to the control portion 93 of the sewing machine and is subjected to a signal processing therein so that the non-lower thread in the bobbin 22 and the amount of the lower thread remaining at that time are detected in the same manner as in the case of the limit sensor 160.

Figure 4:
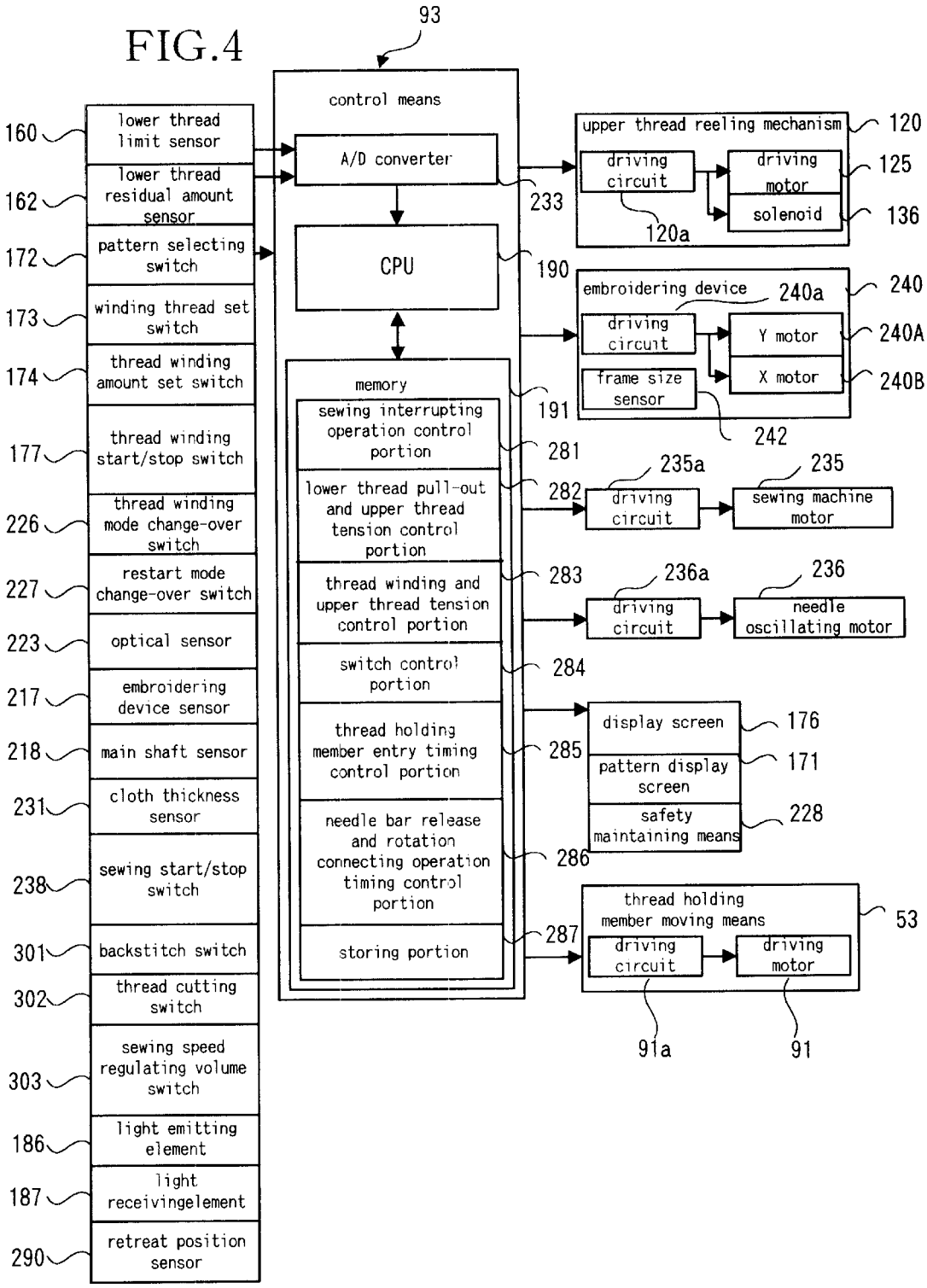
FIG. 4 is a block diagram showing the control portion of the sewing machine in FIG. 1.

As shown in FIG. 4, the control portion (means) 93 of the sewing machine has a CPU 190 and a memory 191 formed by an ROM or RAM having a proper capacity, and a pattern display screen 171 provided in the operating portion of the sewing machine, a pattern selecting switch 172, a winding thread set switch 173, a thread winding amount set switch 174, a display screen 176 which also serves as alarm means and restart notifying means, a thread winding start/stop switch 177, a light emitting element 186 and a light receiving element 187 in dedicated lower thread hold detecting means, a thread winding mode change-over switch 226, a restart mode change-over switch 227 and a sewing start/stop switch 238 are electrically connected to the control portion 93.

Moreover, there are electrically connected, to the control portion 93, a main spindle sensor 218, an optical sensor 223 for detecting an upper thread, a lower thread limit sensor 160, a lower thread residual amount sensor 162, an embroidering device sensor 217 for detecting the state of attachment of an embroidering device 240, a backstitch switch 301, a thread cutting switch 302, a sewing speed regulating volume switch 303, a retreat position sensor 290, safety maintaining means 228 such as a buzzer or a safety lamp, the driving motor 91 of the thread holding member moving means 53, a driving motor 125 and a solenoid 136 in an upper thread reeling mechanism 120, a cloth thickness sensor 231 for detecting the thickness of a workpiece S from the position of the height of a cloth presser 208, a sewing machine motor 235 and a needle oscillating motor 236, and furthermore, a cloth feeding motor power switch and various switches related to a sewing operation.

Furthermore, there are also connected, to the control portion 93, a Y motor 240A for longitudinal feeding and an X motor 240B for transverse feeding (for which a stepping motor is used) in the embroidering device 240, and a frame size sensor 242 for detecting the attachment of the embroidering frame 239 to the carriage 241 of the embroidering device 240 and the size of the embroidering frame 239. The frame size sensor 242 will be described later.

The lower thread limit sensor 160 and the residual amount sensor 162 are connected to the CPU 190 through an A/D converter 233. The driving motor 91 of the thread holding member moving means 53, the driving motor 125 and the solenoid 136 in the upper thread reeling mechanism 120, the sewing machine motor 235, the needle oscillating motor 236 and the driving motors 240A and 240B for the embroidering device 240 are connected through driving circuits (controllers) 91*a*, 120*a*, 235*a*, 236*a*, 240*a* and 327*a* for driving them respectively.

The memory 191 has at least a sewing interrupting operation control portion 281, a lower thread pull-out and upper thread tension control portion 282, a thread winding and upper thread tension control portion 283, a switch control portion 284, a thread holding member entry timing control portion 285, a needle bar separating and rotation connecting operation timing control portion 286, and a storing portion 287 for storing a program or data for carrying out other operation control.

Figure 5:
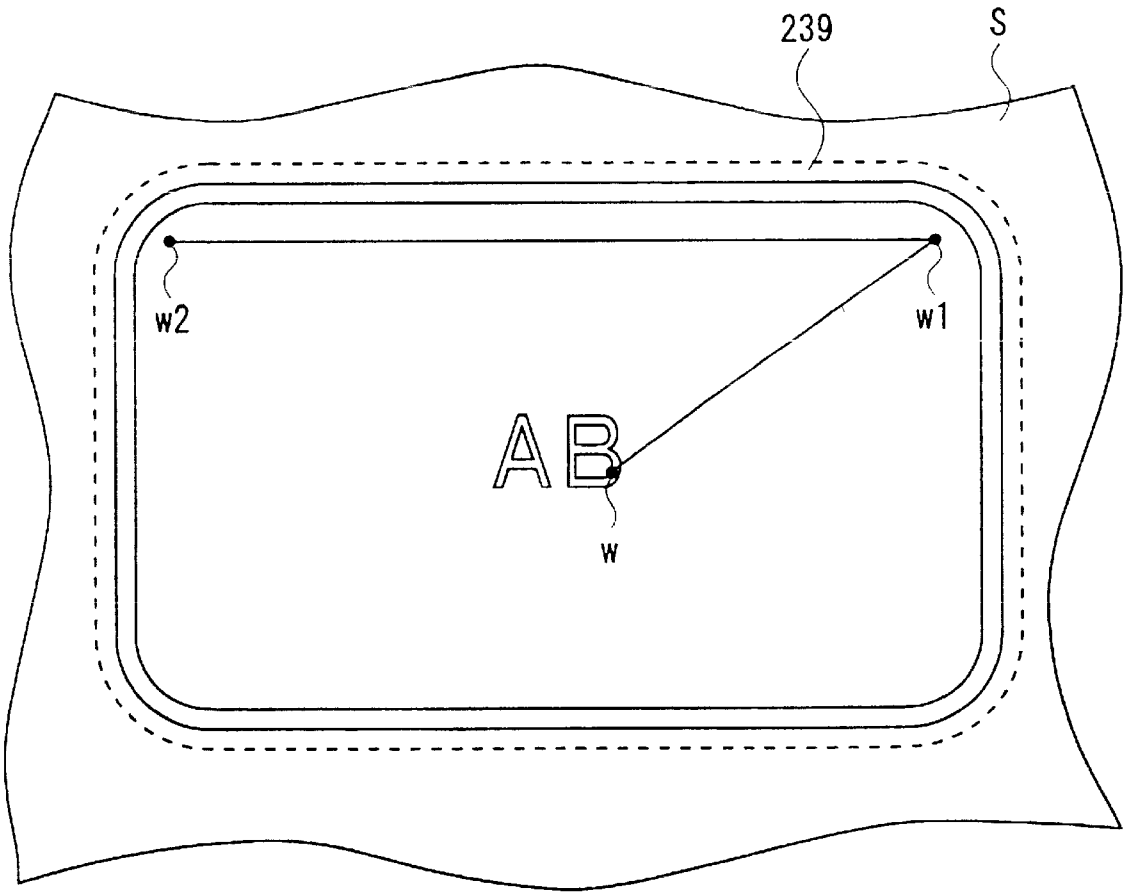
FIG. 5 is a plan view illustrating a state in which a lower thread remaining in the inner bobbin of the horizontally rotary hook of the sewing machine in FIG. 1 is extra sewn onto a workpiece held in an embroidering frame and is thus extracted.

In the embodiment, when the residual amount sensor 162 detects that the lower thread is lessened and outputs a non-lower thread signal, a sewing operation which is being executed is interrupted in the middle of a sewing pattern and extra sewing is then carried out over the corner of a workpiece in order to extract the lower thread remaining in the bobbin 22. More specifically, when the non-lower thread is detected, the sewing operation is interrupted and a needle is moved upward from the workpiece to then stop the sewing machine motor. Subsequently, the X motor and the Y motor in the carriage 241 of the embroidering device 240 are driven to move the embroidering frame 239 from a needle location w of a final stitch depending on the size of the embroidering frame 239 in the direction of the corner of the workpiece S with respect to the needle as shown in FIG. 5. In the case in which the lower thread is gone from the bobbin 22 by only the frame movement, the extra sewing operation is ended. In the case in which the lower thread still remains in the bobbin 22, the sewing machine motor is driven to locate the needle onto the corner of the workpiece S, thereby carrying out the extra sewing operation. The frame movement in the direction of another corner and the needle location are repeated until the lower thread in the bobbin 22 is gone.

Figure 6:
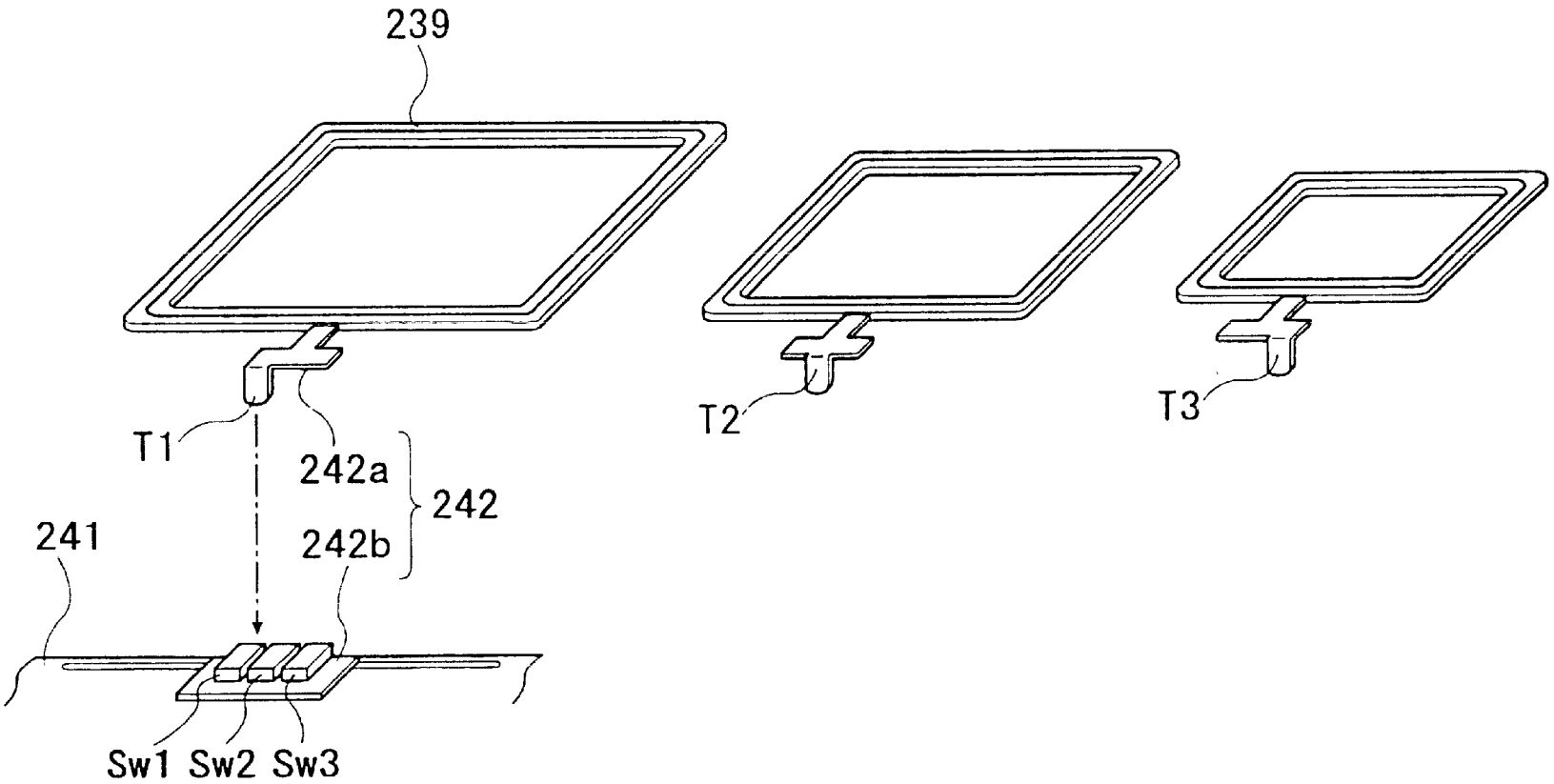
FIG. 6 is a view illustrating a frame size sensor for detecting the size of the embroidering frame of an embroidering device in the sewing machine of FIG. 1.

The size of the embroidering frame 239 is detected by the frame size sensor 242 through the attachment of the embroidering frame 239 to the carriage 241. While the embroidering frame 239 is attached to the carriage 241 with the fitting piece of an attachment portion fitted in the fitting portion of the carriage 241, the sensor portion 240*a* having projections T1, T2 and T3 having different positions according to the size of the embroidering frame 239 is provided in the attachment portion of the embroidering frame 239 separately from the fitting piece (not shown) as shown in FIG. 6. Correspondingly, the fitting portion of the carriage 241 is provided with a switch portion 242*b* having three push switches Sw1, Sw2 and Sw3 as the other components of the frame size sensor 242.

Accordingly, when the embroidering frame 239 is attached to the carriage 241, the projection T (T1 to T3) of the sensor portion 242*a* pushes any of the switches Sw (Sw to Sw3) so that the size of the embroidering frame 239 is detected. A switch ON signal is sent from the switch portion 242*b* to the control portion 93 to recognize the ON signal by means of the CPU 190 so that the size of the embroidering frame 239 can be detected. The embroidering frame 239 is not restricted to have the three sizes but it is possible to detect embroidering frames having seven sizes by pressing at least one of the switches Sw1 to Sw3.

In the embodiment, the extra sewing is carried out over the corner of the workpiece S because the lower thread can be pulled out in a large amount from the bobbin 22 and can be thus extra sewn. Moreover, since the embroidery is rarely made on the corner of the workpiece, the extra sewing operation can be carried out except for the embroidery to be made on the workpiece. In the case of such an embroidery pattern as to make an embroidery on the corner of the workpiece, the extra sewing operation is carried out in a position excluding a pattern which does not reach the embroidery pattern (During the extra sewing operation, the embroidery has already been made on the corner or will be made thereon. In any case, maximum values in the X and Y directions of the embroidery pattern to be placed on a cloth are read from the data and are thus calculated such that the needle is located in a position shifted outward therefrom). By the extra sewing operation, the lower thread is pulled out in a large amount from the bobbin 22. Therefore, the remaining lower thread can be consumed in a large amount.

In the case in which the lower thread remains in a large amount in the bobbin 22 and cannot be completely extracted from the bobbin 22 through the extra sewing operation for one stitch (once), however, the workpiece S is moved again by the movement of the embroidering frame 239 to position an adjacent corner to the corner subjected to a first extra sewing operation of the workpiece S (a first stitch for the extra sewing operation is indicated as w1 in FIG. 5) with respect to the needle and to carry out the extra sewing operation for a second stitch over the same corner. Then, an amount (a distance) required for consuming the amount of the remaining lower thread detected by the residual amount sensor 162 is calculated or read as a specific value and the embroidering frame 239 is moved until the same value is exceeded. By repeating the extra sewing operation over the corner of the workpiece, it is possible to completely extract the remaining lower thread from the bobbin 22.

Figure 7:
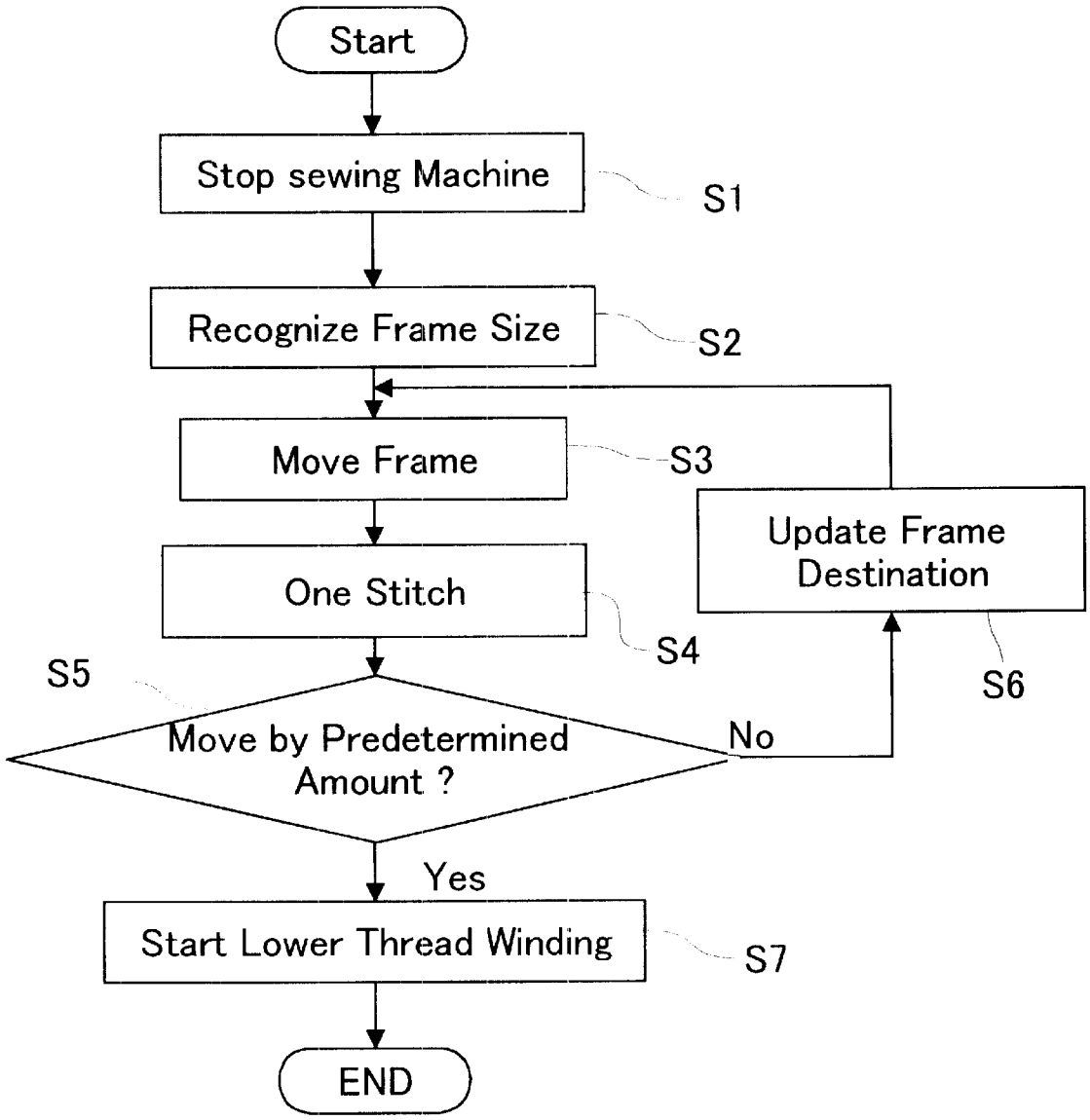
FIG. 7 is a flow chart showing the sequence of a lower thread extracting process in the sewing machine of FIG. 1.

A sequence for the lower thread extracting process in the embodiment will be described with reference to FIG. 7. In FIG. 7, when the sequence for the lower thread extracting process is started, the sewing machine motor is stopped to halt the operation of the sewing machine (Step S1). Next, the size of the embroidering frame 239 which is detected by the frame size sensor 242 is recognized by the CPU of the control portion 93 (Step S2), and the X motor and the Y motor are driven corresponding to the frame size to move the embroidering frame 239, thereby positioning the corner of the workpiece S with respect to the needle (Step S3). Subsequently, the sewing machine motor is driven to once rotate the main spindle (upper shaft) of the sewing machine, thereby locating the needle for one stitch to carry out a first extra sewing operation (Step S4). After the needle is located, it is moved upward and is thus stopped.

Then, the CPU decides whether or not the embroidering frame 239 is moved in an amount required for extracting the remaining lower thread from the bobbin 22 based on the amounts of rotation of the X motor and the Y motor (Step S5). When it is decided that the movement of the embroidering frame 239 does not reach the required amount, the destination of the embroidering frame 239 is updated in order to correspond to a second extra sewing operation to be carried out over the next corner of the workpiece (Step S6). Thereafter, the process returns to the Step S3 and is executed on and after the Step S3. This process is carried out until it is decided that the movement of the embroidering frame 239 reaches the required amount at the Step S5. Thus, when the extra sewing operation for moving in the direction of the corner of the workpiece to locate the needle makes four rounds over the workpiece and the extra sewing operation is to be further carried out continuously, the destination of the embroidering frame 239 is shifted to prevent a stitch for a first round extra sewing operation from overlapping with a stitch for a second round extra sewing operation in the corner of the workpiece when updating the destination of the embroidering frame 239 in the Step S6. This process is also carried out in the case in which the extra sewing operation for two or more rounds is to be performed.

When it is decided that the movement of the embroidering frame 239 reaches the required amount at the Step S5, the lower thread extracting process is completed because the remaining lower thread has completely been extracted from the bobbin 22. Subsequently, a lower thread winding operation is further started and the lower thread winding device 1 is further driven to wind the lower thread upon the bobbin 22 (Step S7) as described above. When the limit sensor 162 detects that the lower thread is wound to have a set maximum thread winding diameter (since the amount of winding of the lower thread can also be detected by a main spindle rotating sensor 218 provided in the main spindle, the detection of the winding of the lower thread to have the set maximum thread winding diameter may be the detection of the OR logic of the limit sensor 162 and the main spindle rotating sensor 218), the winding operation is stopped and the sequence is thus ended.

Then, the lower and upper threads thus extra sewn are cut and removed, and the embroidering frame 239 is moved such that a final stitch w is positioned under the needle at time of the interruption of the embroidering operation for the workpiece S. Thereafter, the interrupted embroidering operation is preferably restarted.

While the extra sewing positions are set in the direction of the four corners of the embroidering frame as described above, it is a matter of course that any of the peripheral portions in the embroidering frame outside an embroidering position formed in the embroidering frame may be used. In the invention, accordingly, it is assumed that the extra sewing operation is carried out with a movement in the direction of the corner including the inner peripheral portion of the embroidering frame. Moreover, the extra sewing operation may be carried out with a reciprocation between two or three corners in place of one round in the direction of the four corners. Moreover, it is also possible to automatically or manually select that the reciprocation is carried out between two, three or four corners depending on the embroidering position.

According to the embroidery sewing machine having a lower thread winding device according to the embodiment having the structure described above, the following functions and effects can be obtained.

(1) Since the lower thread remaining in the bobbin 22 is extra sewn onto the corner of the workpiece S, the lower thread can be pulled out in a large amount from the bobbin and can be thus extra sewn, and can be completely extracted without a remainder in the bobbin so that the reliability of the lower thread extracting process can be enhanced.

(2) Since the lower thread remaining in the bobbin 22 is extra sewn onto the corner of the workpiece S, the extra sewing operation can be carried out excluding an embroidery to be made on the workpiece so that the embroidery can be prevented from being damaged in the extracting process based on the extra sewing operation of the lower thread.

(3) Since the embroidering frame is moved corresponding to the size thereof and the extra sewing is thus carried out over the corner of the workpiece, the extracting process based on the extra sewing operation of the lower thread can be performed in an amount of movement which corresponds to the size of the embroidering frame and has no waste.

(4) Even if precision in the detection of the lower thread residual amount sensor 162 to be an optical sensor is varied by a change in the type of the lower thread (including the upper thread to be used as the lower thread) or the precision in the detection of the lower thread residual amount sensor 162 is deteriorated by adhesion of dust, the remaining lower thread can be pulled out in a large amount and can be completely extracted by the extra sewing operation over the corner of the workpiece. Consequently, the precision of the residual amount sensor can be reduced so that the cost of the sensor can be decreased, and furthermore, the reliability of the process for extracting the lower thread can be prevented from being deteriorated.

(5) Even if the embroidery reaches the corner of the workpiece, the extra sewing operation is carried out in a position excluding the embroidery so that the embroidery can be prevented from being damaged by the extracting process based on the extra sewing operation of the lower thread.

(6) Since the lower thread is automatically started to be wound after the extra sewing operation of the lower thread is ended, it is possible to completely automate the work from the operation for extracting the lower thread remaining in the bobbin to the operation for newly winding the lower thread.

While the embroidery sewing machine having a lower thread winding device uses a horizontally rotary hook in the embodiment, the invention is not restricted thereto. Moreover, the specific structure of each portion of the lower thread winding device is not restricted to that of the embodiment, and furthermore, the structure of the lower thread winding device itself is not restricted to that of the embodiment.

As described above, according to the invention, the lower thread remaining in the bobbin can be extra sewn onto the corner of the workpiece. Therefore, the lower thread can be completely extracted without a remainder in the bobbin so that the reliability of the process for extracting the lower thread can be enhanced. Moreover, the extra sewing operation can be carried out excluding the embroidery to be made on the workpiece and the embroidery can be prevented from being damaged by the extracting process based on the extra sewing operation of the lower thread. Furthermore, the embroidering frame is moved corresponding to the size thereof and the extra sewing operation is thus carried out over the corner of the workpiece. Consequently, it is possible to execute the extracting process based on the extra sewing operation of the lower thread with an amount of movement which corresponds to the size of the embroidering frame and has no waste. In addition, the precision of the residual amount sensor can be reduced so that the cost of the sensor can be decreased.

What is claimed is:

1. An embroidery sewing machine having a lower thread winding device for guiding a thread for a lower thread to a bobbin in a hook and for rotating the bobbin to wind the thread thereupon, comprising an embroidering device for forming an embroidery on a workpiece held in an embroidering frame to be moved in X and Y directions, and a control means for controlling at least said embroidering device and a needle;

wherein when an amount of the lower thread wound upon the bobbin is lessened, said control means moves the embroidering frame in a direction from the formed embroidery to a corner of the embroidering frame to perform an operation such that the needle is located at a position inside the corner of the embroidering frame where the needle is moved upwardly and downwardly, until the lower thread remaining in the bobbin is completely extracted from the bobbin.

2. An embroidery sewing machine according to claim 1, wherein said control means repeats said operation at a plurality of positions inside the corner of the embroidering frame with the needle being once moved upwardly and downwardly in each respective operation until the lower thread remaining in the bobbin is completely extracted from the bobbin.

3. An embroidery sewing machine according to claim 1, wherein said control means determines said position inside the corner of the embroidering frame based on a size thereof, said size being detected by a frame size sensor.

4. An embroidery sewing machine according to claim 1, wherein said control means determines said position inside the corner of the embroidering frame excluding a position in which an embroidering pattern is to be formed.

5. An embroidery sewing machine according to claim 1, wherein said control means starts automatically winding the lower thread from the bobbin after said operation is performed.

6. An embroidery sewing machine according to claim 1, wherein said control means determines said plurality of positions inside the corner of the embroidering frame based on a size thereof said size being detected by a frame size sensor.

7. An embroidery sewing machine according to claim 1, wherein said control means determines said plurality of positions inside the corner of the embroidering frame excluding a position in which an embroidering pattern is to be formed.

8. An embroidery sewing machine according to claim 1, wherein said control means starts automatically winding the lower thread from the bobbin after said operation is performed at said plurality of positions.

9. A An embroidery sewing machine according to claim 1, wherein said control means moves the embroidering frame to said plurality of positions without duplication.

10. An embroidery sewing machine according to claim 1, wherein said position inside the corner of the embroidering frame is allocated along an edge thereof.

* * * * *